US007242880B2

(12) United States Patent
Sone et al.

(10) Patent No.: US 7,242,880 B2
(45) Date of Patent: Jul. 10, 2007

(54) FIXING APPARATUS AND HEATING APPARATUS CONTROL METHOD

(75) Inventors: Toshihiro Sone, Yokohama (JP); Osamu Takagi, Chofu (JP); Satoshi Kinouchi, Tokyo (JP); Yoshinori Tsueda, Fuji (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/082,198

(22) Filed: Mar. 17, 2005

(65) Prior Publication Data

US 2006/0210293 A1 Sep. 21, 2006

(51) Int. Cl.
*G03G 15/20* (2006.01)

(52) U.S. Cl. ..... 399/33; 399/67; 399/69

(58) Field of Classification Search ..... 399/33, 399/67, 69, 320, 328; 219/216
See application file for complete search history.

(56) References Cited

U.S. PATENT DOCUMENTS 6,026,273 A 2/2000 Kinouchi et al.
6,078,781 A 6/2000 Takagi et al.
6,087,641 A 7/2000 Kinouchi et al.
6,097,926 A 8/2000 Takagi et al.
6,137,985 A 10/2000 Kinouchi et al.
6,154,629 A 11/2000 Kinouchi et al.
6,212,344 B1 4/2001 Takagi et al.
6,337,969 B1 1/2002 Takagi et al.
6,415,128 B1 7/2002 Takagi et al.
6,438,335 B1 8/2002 Kinouchi et al.
6,643,476 B1 11/2003 Kinouchi et al.
6,643,491 B2 11/2003 Kinouchi et al.
6,724,999 B2 4/2004 Kikuchi et al.
6,725,000 B2 4/2004 Takagi et al.

(Continued)

FOREIGN PATENT DOCUMENTS

JP 5-289572 A 11/1993

(Continued)

OTHER PUBLICATIONS

U.S. Appl. No. 10/378,859, filed Mar. 5, 2003, Sone et al.

(Continued)

*Primary Examiner*—David M. Gray
*Assistant Examiner*—Laura K. Roth
(74) *Attorney, Agent, or Firm*—Foley & Lardner LLP

(57) ABSTRACT

A fixing apparatus according to one aspect of the present invention comprises a first non-contact temperature detecting section which detects a surface temperature of a heat roller in the vicinity of a heating apparatus, a second non-contact temperature detecting section which is provided in non-contact with a surface of each of a heat roller and a pressure roller, and which detects a surface temperature of at least one of the heat roller and the pressure roller, and a control section which compares a difference between a first temperature detected by the first non-contact temperature detecting section and a second temperature detected by the second non-contact temperature detecting section with a predetermined specified temperature difference, and when the difference between the first temperature and the second temperature is greater than the specified temperature difference for a predetermined period or longer, stops heating of the heat roller by the heating apparatus.

12 Claims, 8 Drawing Sheets

U.S. PATENT DOCUMENTS

| | | | | |
|---|---|---|---|---|
| 6,763,206 | B2 | 7/2004 | Kinouchi et al. | |
| 6,861,627 | B2 | 3/2005 | Wasai et al. | |
| 6,861,630 | B2 | 3/2005 | Kinouchi et al. | |
| 6,868,249 | B2 | 3/2005 | Kinouchi et al. | |
| 6,871,041 | B2 | 3/2005 | Takagi et al. | |
| 6,889,018 | B2 | 5/2005 | Kinouchi et al. | |
| 6,898,409 | B2 | 5/2005 | Tsueda et al. | |
| 6,898,410 | B2 * | 5/2005 | Boss | 399/69 |
| 6,900,419 | B2 | 5/2005 | Takagi et al. | |
| 2002/0007752 | A1 * | 1/2002 | Sakagami | |
| 2004/0238531 | A1 | 12/2004 | Kikuchi et al. | |
| 2004/0265021 | A1 | 12/2004 | Kinouchi et al. | |
| 2005/0008413 | A1 | 1/2005 | Takagi et al. | |
| 2005/0074252 | A1 * | 4/2005 | Hirst et al. | 399/69 |

FOREIGN PATENT DOCUMENTS

| | | | |
|---|---|---|---|
| JP | 9-281843 | A | 10/1997 |
| JP | 10-31390 | A | 2/1998 |
| JP | 2003-17221 | A | 1/2003 |
| JP | 2004-21079 | A | 1/2004 |

OTHER PUBLICATIONS

U.S. Appl. No. 10/799,770, filed Mar. 15, 2004, Kikuchi et al.
U.S. Appl. No. 10/805,305, filed Mar. 22, 2004, Sone et al.
U.S. Appl. No. 10/805,308, filed Mar. 22, 2004, Tsueda et al.
U.S. Appl. No. 10/805,420, filed Mar. 22, 2004, Sone et al.
U.S. Appl. No. 10/805,507, filed Mar. 22, 2004, Kikuchi et al.
U.S. Appl. No. 10/805,514, filed Mar. 22, 2004, Kinouchi et al.
U.S. Appl. No. 10/805,522, filed Mar. 22, 2004, Kikuchi et al.
U.S. Appl. No. 10/806,392, filed Mar. 23, 2004, Takagi et al.
U.S. Appl. No. 10/820,138, filed Apr. 8, 2004, Sone et al.
U.S. Appl. No. 10/944,707, filed Sep. 21, 2004, Sone et al.
U.S. Appl. No. 10/944,855, filed Sep. 21, 2004, Sone et al.
U.S. Appl. No. 10/945,395, filed Sep. 21, 2004, Kinouchi et al.
U.S. Appl. No. 11/078,421, filed Mar. 14, 2005, Takagi et al.
U.S. Appl. No. 11/078,725, filed Mar. 14, 2005, Takagi et al.
U.S. Appl. No. 11/078,726, filed Mar. 14, 2005, Tsueda et al.
U.S. Appl. No. 11/080,833, filed Mar. 16, 2005, Tsueda et al.
U.S. Appl. No. 11/080,943, filed Mar. 16, 2005, Sone et al.
U.S. Appl. No. 11/082,218, filed Mar. 17, 2005, Tsueda et al.
U.S. Appl. No. 11/082,242, filed Mar. 17, 2005, Sone et al.
U.S. Appl. No. 11/080,942, filed Mar. 16, 2005, Kinouchi et al.
U.S. Appl. No. 11/080,909, filed Mar. 16, 2005, Kinouchi et al.

* cited by examiner

FIXING APPARATUS AND HEATING APPARATUS CONTROL METHOD

FIELD OF THE INVENTION

The present invention relates to an image forming apparatus which forms an image on a transfer material by using an electronic photography process and a fixing apparatus mounted on a copying machine, a printer or the like to fix a developer onto the transfer material.

BACKGROUND OF THE INVENTION

In a copying machine or a printer using an electronic process, it is well known that a toner image formed on a photosensitive drum is transferred to a transfer material, and then, a toner image molten by a fixing apparatus including a heat roller and a pressure roller is fixed to the transfer material.

At this time, there is known a method of detecting a surface temperature by using a detecting element brought into contact with a surface of the heat roller and controlling a temperature of the heat roller. However, the contact temperature detecting element may degrade the surface of the heat roller due to sliding and has a problem that a service life of the heat roller is reduced. In addition, responsiveness of the detecting element is degraded due to surface degradation, whereby a temperature may be incorrectly detected.

Further, it is known to use a temperature detecting element which senses a red infrared ray radiated from a heat roller to detect a temperature of a heat roller in a non-contact manner.

However, at a radiation rate of the red infrared ray from the heat roller detected by a non-contact temperature detecting element, the surface of the heat roller is gradually degraded by the heat roller coming into contact with a transfer material which holds a toner. Thus, a deviation occurs at the life beginning of using the heat roller and at the life end of using the heat roller. In addition, the degradation of the surface of the heat roller is different depending on type or size of a transfer material passing through paper, and thus, a deviation occurs in a longitudinal direction of the roller at a red infrared ray-radiation rate. That is, a time for a temperature detected by the non-contact temperature element to reach a set temperature is delayed due to a change of red infrared ray radiation.

For example, in Jpn. Pat. Appln. KOKAI Publication No. 2004-21079, there is disclosed a fixing apparatus for pinching, transferring, and heating a recording agent having an image carried by a nip formed of first and second fixing members. In this fixing apparatus, first and second temperature sensing means each have a heat source in the vicinity of the nip and are allocated in non-contact with the heat source. In the case where a difference in sensing temperature between the first and second sensing means is obtained as a predetermined value or more, the heat source is stopped or the heat source is controlled at a lower temperature than a control temperature when fixing is executed. There is disclosed a technique of allocating the first temperature sensing and the second temperature sensing means at their different positions in the longitudinal direction of the nip.

In addition, in Jpn. Pat. Appln. KOKAI Publication No. 2003-017221, there is disclosed a heating apparatus comprising: a heat roller heated by a heating source; external heating means for carrying out heating from at least the outside of the heat roller serving as the heating source; and a safety temperature sensing member which shuts out power supply to the external heating means. The publication discloses a technique of allocating the safety temperature sensing member on a heating region at which the external heating means heats the heat roller and covering a gap between the safety temperature sensing member and a coil serving as the external heating means with a magnetic force shield member.

Further, as disclosed in Jpn. Pat. Appln. KOKAI Publication No. 5-289572, there is known an invention relating to an apparatus comprising: a thermal fixing section which fixes an image onto a recording medium by heating; first temperature detecting means for detecting a temperature of a position through which the recording medium on the thermal fixing section does not pass; second temperature detecting means for detecting a temperature of a position through which the recording medium on the thermal fixing section passes; determining means for determining whether or not a temperature difference between a detected temperature by the first temperature detecting means and a detected temperature of the second temperature detecting means is at a predetermined level or higher; and control means for shielding power supply to the thermal fixing section in accordance with affirmative determination of the determining means.

In addition, as disclosed in Jpn. Pat. Appln. KOKAI Publication No. 10-031390, there is known a technique using non-contact temperature detecting means which has self temperature detecting means, thereby recognizing a temperature T of the heat roller as a multi-order formula between a self temperature output T1 and a sensor output T0 of a non-contact temperature sensor, the sensor output being sensed and outputted according to the self temperature output and a heat roller temperature which is non-sample, and controlling the temperature of the heat roller.

Moreover, Jpn. Pat. Appln. KOKAI Publication No. 9-281843 discloses an electro photography apparatus having a non-contact sensor which senses a temperature of a heat roller in a non-contact manner, the apparatus controlling the temperature of the heat roller by a sensor output of the non-contact temperature sensor. The electro photography apparatus has means (fan) for supplying air from a pair of image carriers to a fixing apparatus, and the non-contact sensor is allocated so as to include at least a part of the sensor in air between the fixing apparatus and each of the image carriers.

BRIEF SUMMARY OF THE INVENTION

According to an aspect of the present invention, there is provided a fixing apparatus comprising:

a heat roller which supplies a heat to sheet;

a pressure roller which comes into contact with the heat roller;

a heating apparatus having a plurality of heating members which heat the heat roller;

a first non-contact temperature detecting section which is provided in non-contact with a surface of the heat roller, and which detects a surface temperature of the heat roller in the vicinity of the heating apparatus;

a second non-contact temperature detecting section which is provided in non-contact with the surfaces of the heat roller and the pressure roller, and which detects a surface temperature of at least one of the heat roller and the pressure roller; and a control section which compares a difference between a first temperature detected by the first non-contact temperature detecting section and a second temperature detected by the second non-contact temperature detecting section with a predetermined specified temperature difference, and when the difference between the first temperature and the second temperature is greater than the specified temperature difference for a predetermined period or longer, stops heating of the heat roller by the heating apparatus.

According to another aspect of the present invention, there is provided a heating apparatus control method comprising:

utilizing a heating apparatus which includes a plurality of inductive heating coils allocated outside of a heat roller, thereby heating an outer periphery face of the heat roller;

detecting a first temperature from a first non-contact temperature detecting section which detects a surface temperature of the heat roller in the vicinity of the inductive heating coil;

detecting a second temperature from a second non-contact temperature detecting section which detects a temperature of a surface region of the heat roller which is distant from a region detected by the first non-contact temperature detecting section;

determining whether or not a temperature difference between the first temperature and the second temperature has reached a first specified temperature difference; and when the temperature difference between the first temperature and the second temperature has reached the first specified temperature difference, stopping heating of the heat roller by the heating apparatus in the case where a period in which the first specified temperature difference has been reached reaches a predetermined period or more.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, an example of a fixing apparatus to which an embodiment of the present invention can be applied will be described with reference to the accompanying drawings.

Figure 1:
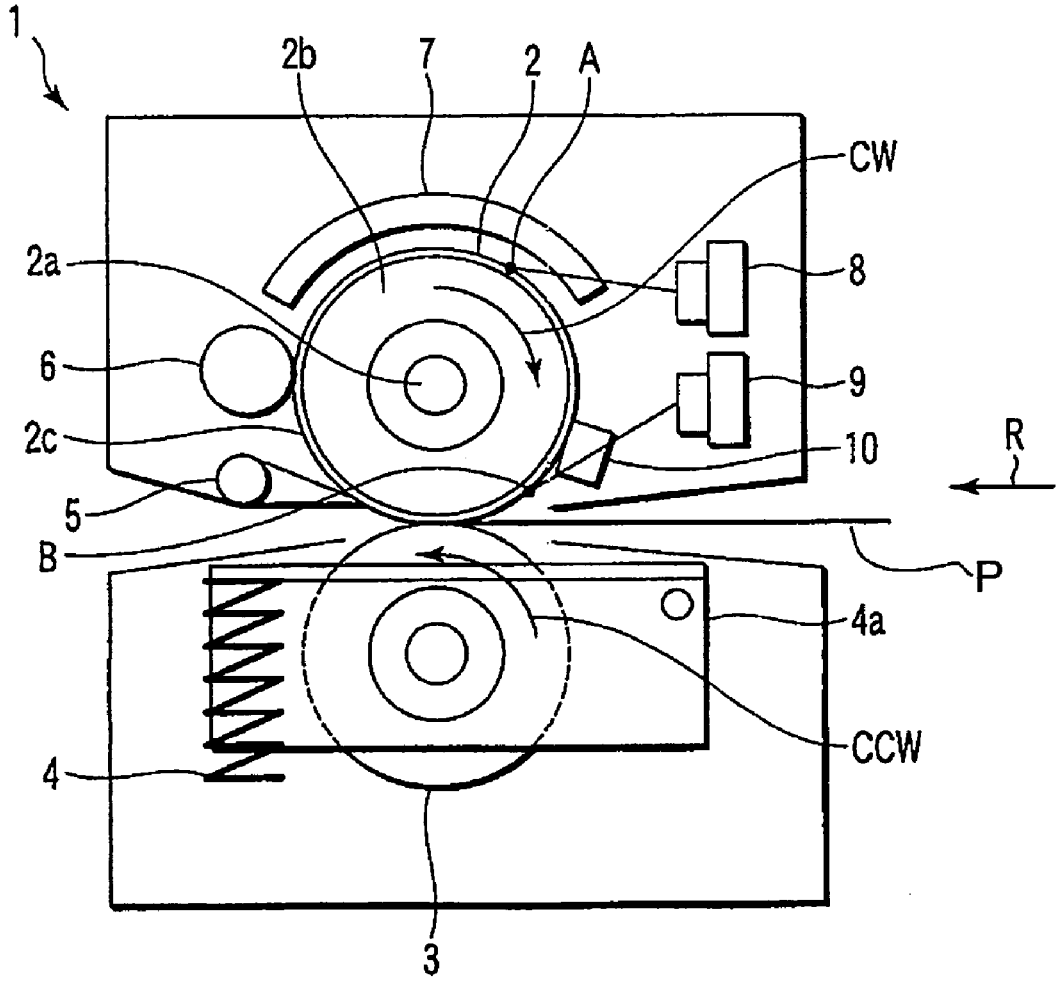
FIG. 1 is a schematic view illustrating an example of a fixing apparatus to which an embodiment of the present invention can be applied.

FIG. 1 shows an example of the fixing apparatus to which the embodiment of the present invention is applied.

As shown in FIG. 1, a fixing apparatus 1 has a heating member (heat roller) 2; a pressure member (press roller) 3; a pressurizing spring 4; a release claw 5; a cleaning roller 6; an inductive heating device 7; a first temperature detecting section 8; a second temperature detecting section 9; and a thermostat 10.

The heat roller 2 has: a shaft 2*a* composed of a material having rigidity (hardness) which is not deformed at a predetermined pressure; elastic layers 2*b* (a foam rubber layer, a sponge layer, and a silicon rubber layer) allocated in order around the shaft 2*a*; and an conductive layer 2*c* (a metal conductive layer). In the embodiment, although not shown, it is preferable that a solid rubber layer and a mold release layer made of a thin film layer such as, for example, a heat resistance silicone rubber are further formed outside of the metal thin film layer 2*c*.

The metal conductive layer 2*c* is formed of an electrically conducting material (such as nickel, stainless steel, aluminum, copper, and a compound material of stainless steel and aluminum). It is preferable that a length of the heat roller 2 in the longitudinal direction is 330 mm.

It is preferable that the foam rubber layer 2*b* is formed to have thickness of 5 mm to 10 mm, that the metal conductive layer 2*c* is formed to have thickness of 10 μm to 100 μm, and that the solid rubber layer is formed to have thickness of 100 μm to 200 μm, respectively. In the embodiment, the foam rubber layer 2*b* is formed to have thickness of 5 mm, the metal conductive layer 2*c* is formed to have thickness of 40 μm, the solid rubber layer is formed to have thickness of 200 μm, and the mold release layer is formed to have thickness of 30 μm, respectively. The heat roller 2 has a diameter of 40 mm.

The pressure roller 3 may be an elastic roller covered with a silicone rubber, a fluorine rubber or the like having a predetermined thickness around a rotary shaft having a predetermined diameter. In addition, like the heat roller 2, the pressure roller may be a roller having a metal electrically conductive layer and an elastic layer.

The pressurizing spring 4 brings pressure contact with an axle of the heat roller 2 at a predetermined pressure, and the pressure roller 3 is approximately maintained in parallel to the axle of the heat roller 2. The pressurizing spring 4 can be set in parallel to the heat roller 2 because a predetermined pressure is supplied from both ends of the pressure roller 3 via a pressurizing support bracket 4*a* for supporting the axis of the pressure roller 3.

In this manner, a nip having a predetermined width is formed between the heat roller 2 and the pressure roller 3.

The heat roller 2 is rotated in a clockwise (CW) direction indicated by the arrow at an approximately constant speed by means of a fixing motor 23 described later with respect to FIG. 2. The pressure roller 3 is brought into contact with the heat roller 2 at a predetermined pressure by means of the pressurizing spring 4. Thus, the heat roller 2 is rotated, whereby the pressure roller 3 is rotated at a position which comes into contact with the heat roller 2 in an opposite (CCW) direction to that in which the heat roller 2 is rotated.

The release claw 5 is positioned on the periphery of the heat roller 2 at the downward side in the direction in which the heat roller 2 is rotated by a nip where the heat roller 2 and the pressure roller 3 come into contact with each other, and at a predetermined position in the vicinity of the nip to release paper P which is passed through the nip from the heat roller 2. The present invention is not limited to the embodiment. For example, in the case where a large amount of developer is fixed to paper when a color image is formed, the paper is hardly released from the heat roller. Thus, a plurality of release claws 5 may be provided. In addition, if the paper is easily released from the heat roller, these release claws may not be provided.

The cleaning roller 6 removes dust such as the toners, paper chips and the like offset on the surface of the heat roller 1.

The induction heating device 7 is allocated outside of the heat roller 2, and has at least one heating coil (exciting coil) to which predetermined power is supplied to supply a predetermined magnetic field to the heat roller 2. Predetermined power is supplied from an exciting circuit 22 to the heating coil, and thus, the heat roller 2 is heated at a predetermined temperature.

The first temperature detecting section 8 is provided in non-contact with a surface of the heat roller 2. The detecting section detects a temperature of a first detection position A whose temperature is high from among the outer peripheral face of the heat roller 2. The first temperature detecting section 8 in the embodiment is configured to detect a temperature immediately after an outlet of the exciting coil 7 in the rotation direction of the heat roller 2. The invention is not limited to this configuration. For example, a region may be opposite to an exciting coil of the induction heating device 7 of the outer periphery face of the heat roller 2.

The second temperature detecting section 9 is provided in non-contact with the surface of the heat roller 2. The detecting section detects a temperature of a second detection position B which is at the downstream side in the rotation direction of the heat roller 2 of the first detection position A and which is immediately before the nip portion. That is, the second detection position B is defined as a detection position whose phase is different from that of the first detection position A in the rotation direction of the heat roller 2.

The thermostat 10 senses a heating failure that the surface temperature of the heat roller 2 abnormally rises. If a heating failure occurs, the thermostat is utilized in order to shut out the power supplied to the heating coil of the induction heating device 7. It is preferable that at least one or more thermostats 10 are provided in the vicinity of the surface of the heat roller 2.

In addition, on the periphery of the pressure roller 3, there may be provided a release claw for releasing the paper P from the pressure roller 3 or a cleaning roller for removing the toner adhered to the peripheral face of the pressure roller 3.

The paper P holding the toner is passed through the nip portion formed between the heat roller 2 and the pressure roller 3, whereby the molten toner is brought into contact with the paper P, and an image is fixed.

Figure 2:
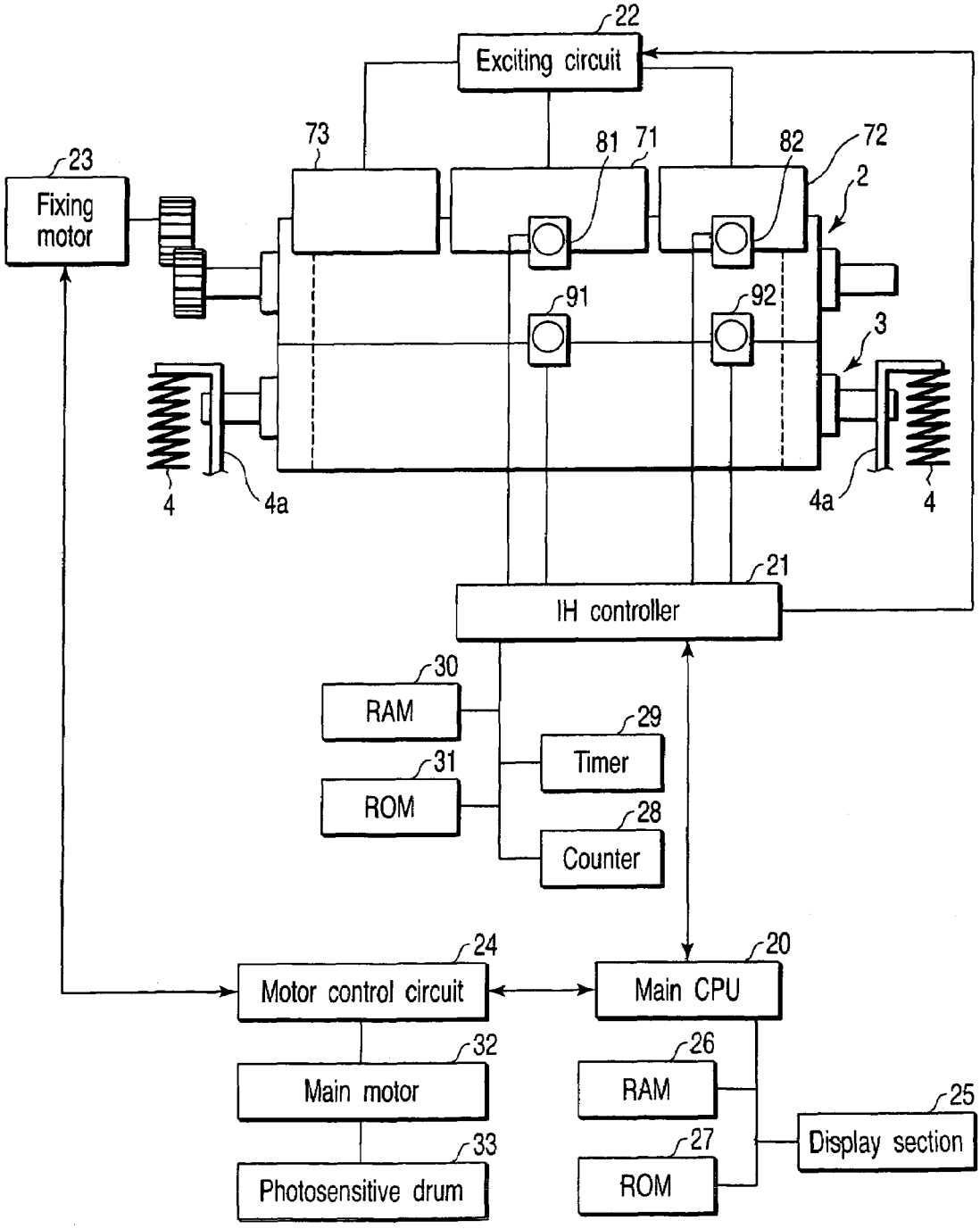
FIG. 2 is a block diagram illustrating a control system of the fixing apparatus shown in FIG. 1.

FIG. 2 is a block diagram illustrating a control system of the fixing apparatus shown in FIG. 1. FIG. 2 is also a schematic view showing the fixing apparatus shown in FIG. 1 when it is seen in a direction indicated by the arrow R As shown in FIG. 2, the induction heating device 7 includes inductive heating coils 71, 72, and 73. The coil 71 is allocated to be opposed to a center portion in the axial direction of the heat roller 2. This coil provides a magnetic field to the center portion of the heat roller 2. The coils 72, 73 each are allocated to be opposed to an end portion in the axial direction of the heat roller 2. These rollers each provide a magnetic field to an end portion of the heat roller 2.

The first temperature detecting section 8 includes a plurality of non-contact temperature detecting elements allocated in the longitudinal direction of the heat roller 2, for example, non-contact temperature detecting elements 81, 82. The non-contact temperature detecting elements 81, 82 each include: a thermo pile type temperature sensor (thermo pile) which is a non-contact temperature element capable of detecting temperatures of one or more sites by one element and which is capable of detecting a temperature by utilizing a red infrared ray; and a thermister for detecting an ambient temperature in the vicinity of the thermo pile. The non-contact temperature detecting elements 81, 82 each can detect a target temperature detected by the thermo pile and surface temperatures (roller temperatures) Rt81, Rt82 of the heat roller 2 on the basis of the ambient temperature detected by the thermister.

The non-contact temperature detecting element 81 detects a temperature of the first detection position A on the surface of the heat roller 2 opposed to the coil 71. The non-contact temperature detecting element 82 detects a temperature of the first detection position A on the surface of the heat roller 2 opposed to the coil 72.

The second temperature detecting section 9 includes a plurality of non-contact temperature detecting elements allocated in the longitudinal direction of the heat roller 2, for example, non-contact temperature detecting elements 91, 92. Like the non-contact temperature detecting elements 81, 82 described above, the non-contact temperature detecting elements 91, 92 each are provided as a non-contact temperature detecting elements capable of detecting temperatures of one or more sites by one element. These detecting elements each include a thermo pile and a thermister which detects an ambient temperature in the vicinity of the thermo pile. These detecting elements can detect a target temperature detected by the thermo pile and the surface temperature (roller temperature) of the heat roller 2 on the basis of the ambient temperature detected by the thermo pile. In detail, the non-contact temperature detecting element 91 detects a roller temperature Rt91 of the second detection position B positioned at the downstream side of the first detection position A and immediately before the nip in the rotation direction of the heat roller 2 opposed to the coil 71. The non-contact temperature detecting element 92 detects a roller temperature Rt92 of the second detection position B positioned at the downstream side of the first detection position A and immediately before the nip in the rotation direction of the heat roller 2 opposed to the coil 72.

In addition, as shown in FIG. 2, a main CPU 20 is connected to an IH controller 21, the exciting circuit 22, the fixing motor 23, a motor drive circuit 24, a display section 25, a RAM 26, and a ROM 27.

The main CPU 20 integrally controls a fixing operation of the fixing apparatus 1.

The IH controller 21 controls the exciting circuit 22 to input roller temperature information on the heat roller 2 detected by the non-contact temperature detecting elements 81, 82, 91, 92 and to supply predetermined power base on the temperature information or the like to the coils 71 to 73 of the induction heating device 7. In more detail, the IH controller 21 controls the temperature of the heat roller 2 to be increased and maintain to a fixing temperature required for fixing, uniformly in the axial direction, based on the roller temperatures Rt81, Rt82, Rt91, Rt92 of the heat roller 2 outputted from the non-contact temperature detecting elements 81, 82, 91, 92.

The IH controller 21 is connected to a counter 28, a timer 29, a RAM 30, and a ROM 31.

The ROM 31 stores predetermined set values for use in control by the IH controller 21. In the embodiment, the ROM stores a first specified value temperature, a second specified value temperature, a set value of a first specified value temperature excess count C1, a set value of a second specified value temperature excess count C2, and the like.

The first specified value temperature is provided as a threshold value for sensing an error in the case where a part of the heat roller 2 is excessively heated when the roller temperature Rt81 detected by the non-contact temperature detecting element 81 for sensing the temperature of the first detection position A is less than a predetermined specified value, for example, a set value (160° C.) which is a fixing temperature. That is, when the roller temperature Rt81 is less than a set value (160° C.), it is determined that a part of the heat roller 2 is excessively heated, and an error is detected in the case where the fact that a difference between the roller temperature Rt91 detected by the non-contact temperature detecting element 91 for sensing the temperature of the second detection position B and the roller temperature Rt81 is equal to or greater than the first specified value temperature has been continuously counted by a predetermined specified value or more.

Similarly, the second specified value temperature is provided as a threshold value for sensing an error in the case where a part of the heat roller 2 is excessively heated when the roller temperature Rt81 detected by the non-contact temperature detecting element 81 for sensing the temperature of the first detection position A is equal to or higher than a predetermined specified value, for example, a set value (160° C.) which is a fixing temperature. That is, when the roller temperature Rt81 is equal to or higher than a set value (160° C.), it is determined that a part of the heat roller 2 is excessively heated, and an error is detected in the case where the fact that a difference between the roller temperature Rt91 detected by the non-contact temperature detecting element 91 for sensing the temperature of the second detection position B and the roller temperature Rt81 is equal to or greater than the second specified value temperature has been continuously counted by a predetermined specified value or more.

The counter 28 counts the first specified value temperature excess count C1 or the second specified value temperature excess count C2. That is, the counter 28 adds 1 to an initial value (zero) of the first specified value temperature excess count C1 or the second specified value excess count C2 every time the difference between the roller temperature Rt81 and the roller temperature Rt91, or alternatively, the difference between the roller temperature Rt82 and the roller temperature Rt92 continuously reaches the first specified value temperature or the second specified value temperature or more. The counter 28 resets counting in the case where the difference between the roller temperature Rt81 and the roller temperature Rt91 does not continuously reach the first specified value temperature or more.

The exciting circuit 22 supplies predetermined power to the coils 71 to 73 in response to a control signal outputted from the IH controller 21. In this manner, each of the coils 71 to 73 generates a magnetic flux which is a predetermined heating force. This heating force is provided as a size of the magnetic force which forms a base for the heat roller 2 to generate an eddy current. This heating force is determined depending on the size of the power supplied to each of the coils 71 to 73. For example, in the case where the paper passes through the center portion of the heat roller 2, predetermined power for exciting the coil 71 is outputted. In the case where the paper passes through the center portion and end portion of the heat roller 2, predetermined power for exciting the coils 71 to 73, for example, 1300 W is outputted.

The motor driver circuit 24 is connected to the fixing motor 23 which rotates the heat roller 2. The motor driver circuit may be also connected to a main motor 32 which rotates a photosensitive drum 33.

The display section 25 displays a device internal state message or a user message. For example, the display section 25 displays a service personnel inspection mode and notifies a user of cleaning or replacement of the heat roller 2 or cleaning of the first temperature detecting section 8 or the second temperature detecting section 9.

When power is turned ON, the IH controller 21 controls the exciting circuit 22 so that predetermined power is supplied to the coils 71 to 73 on the basis of the roller temperatures Rt81, Rt82, Rt91, Rt92 of the heat roller 2 detected by the non-contact temperature detecting elements 81, 82, 91, 92. The coils to which the predetermined power has been supplied generate a magnetic field according to the power. An eddy current flows into the metal conductive layer 2*c* of the heat roller 2 having received this magnetic field, and the metal conductive layer 2*c* generates a heat. Then, the paper P holding the toner passes between the heat roller 2 and the pressure roller 3, whereby the molten toner is brought into pressure contact with the paper P, and an image is fixed.

Figure 3:
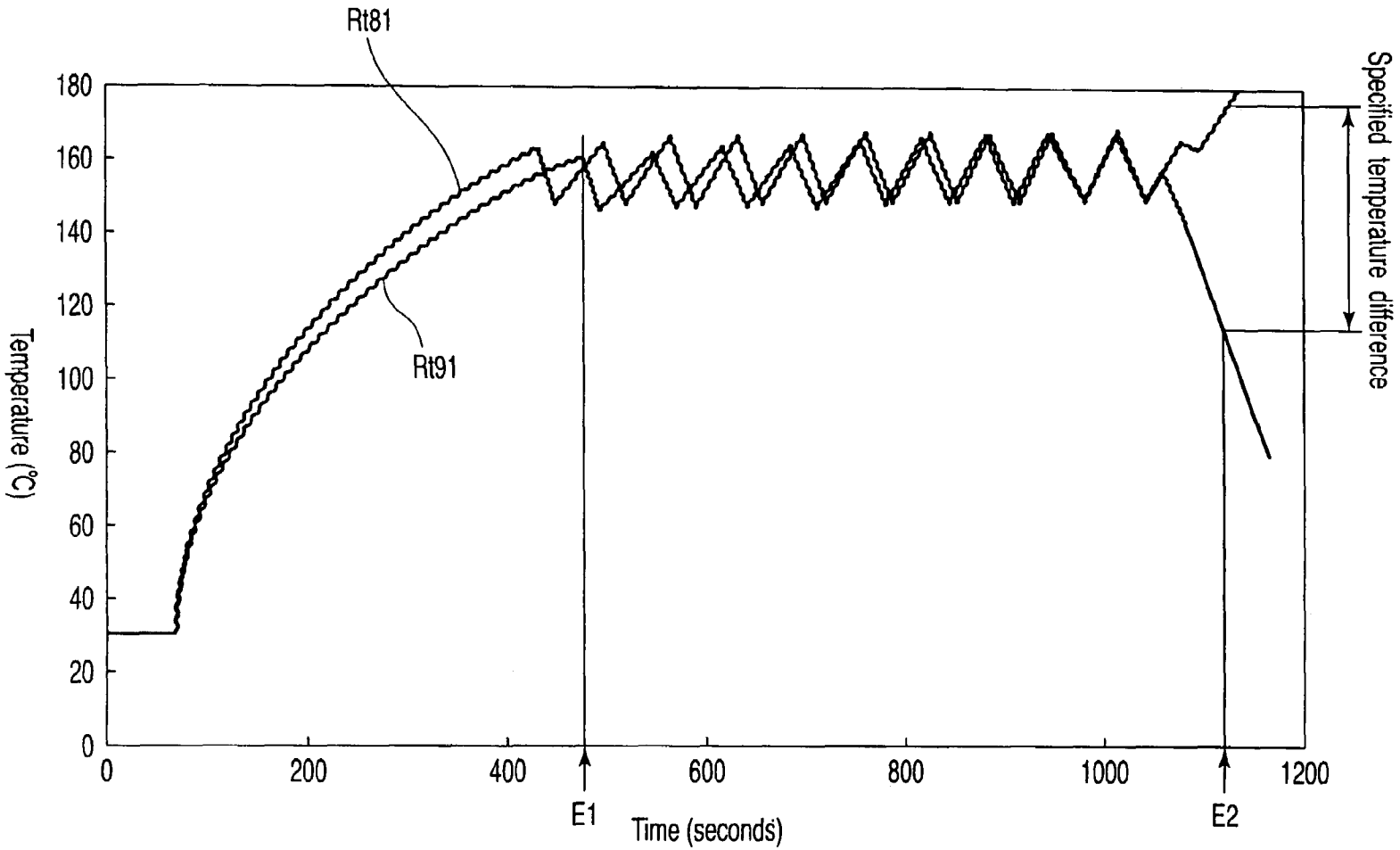
FIG. 3 is a view showing a relationship between a detected temperature detected by first and second temperature detecting sections and a time in a fixing apparatus for rotating a heat roller at the same time as when warming-up control is made.

Now, temperature control according to the present embodiment will be described with reference to FIG. 3. FIG. 3 is a view showing a relationship between a detected temperature detected by first and second detecting sections 8, 9 and a time in a fixing apparatus which rotates the heat roller 2 at the same time as when warming-up control is made.

The IH controller 21 executes temperature control of a warming-up mode, a fixing mode, and a ready mode on the basis of the detected temperature by the first and second temperature detecting sections 8 and 9.

Warming-up control is provided as a control for increasing the surface temperature of the heat roller 2 to the set temperature (160° C.) as shown in FIG. 3. In the embodiment, all of the power which can be supplied is supplied to be distributed to the coils 71 to 73, and the surface of the heat roller 2 is heated in a short time. Until warming-up has completed, a print reservation state is established without executing a fixing operation even in the case where a print instruction is supplied.

Fixing mode control is started (E1) in response to a print command after warming-up has completed. That is, this mode control is provided as a control for heating a region in which a temperature is lowered by the fixing operation of the fixing apparatus and minimizing a temperature difference in the axial direction of the heat roller 2. Specifically, the IH controller 21 heats a region in which a temperate is lower on the basis of the detected temperature detected by the first and second temperature detecting sections 8, 9, and the surface temperature of the heat roller 2 is increased to a set value (160° C.) which is a fixing temperature.

Ready mode control is provided as a control for maintaining the surface temperature of the heat roller 2 to a set value while waiting for a print command. However, in the case where the user's print command is not supplied for a predetermined time or longer, an energy saving mode is established. The set value of the surface temperature of the heat roller 2 is changed to a temperature which is lower than the fixing temperature and which can be restored within a short time, so that the power supplied to the coils 71 to 73 is restricted.

Incidentally, in the case (E2) where the heat roller 2 has stopped, and only a part of the surface of the heat roller 2 is heated by the induction heating device 7, the temperature Rt81 in the vicinity of an exit of the induction heating device 7 continuously rises as shown in FIG. 3, and the temperature Rt91 near the nip is lowered because the heat is lost by the pressure roller 3. Thus, the surface temperature of the heat roller 2 in the vicinity of the induction heating device 7 continuously rises, and the roller is heated up to a temperature which is much higher than a set value, and is overshot. In addition, if the roller is heated up to a very high temperature, the heat roller 2 is heavily damaged, and responsiveness of the detecting element is degraded. Consequently, there is a problem that a temperature is mistakenly detected, and the service life of the heat roller is reduced.

As described above, the heating apparatus and heating apparatus control method according to the present invention are featured in that, in the case where a difference between the temperature in the vicinity of the exit of the induction heating device 7 and the temperature near the nip is equal to or greater than the predetermined first specified temperature difference or in the case where the continuously counted first specified value temperature excess count C1 has exceeded a predetermined specified value, an error is detected, and heating by the induction heating device 7 is stopped. In this manner, the above-described problem can be avoided.

Now, an example of a heating apparatus control method according to the present invention will be described with reference to FIG. 4.

Figure 4:
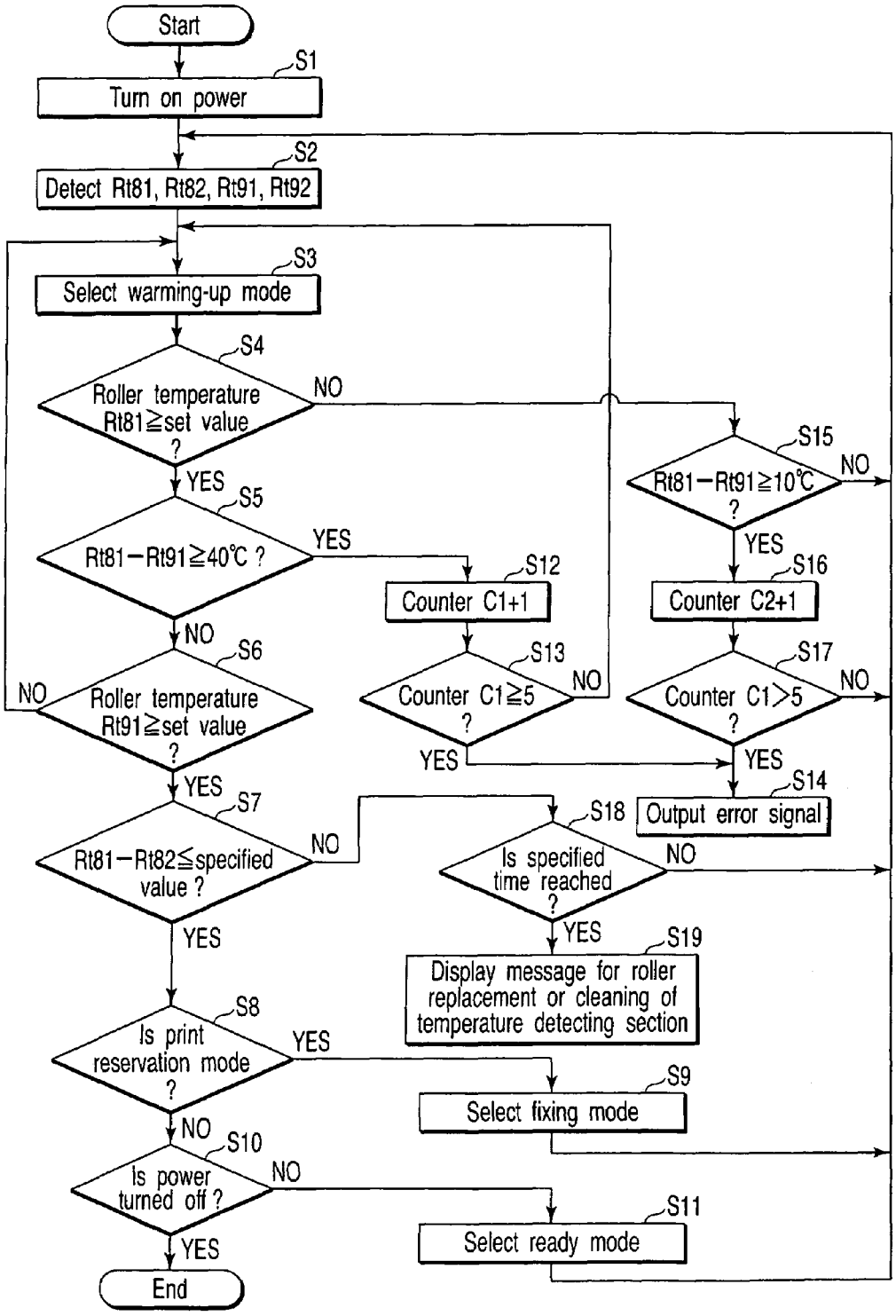
FIG. 4 is a flow chart showing an example of a heating apparatus control method which can be applied to the fixing apparatus shown in FIG. 1.

As shown in FIG. 4, when the fixing apparatus is powered ON (S1), the IH controller 21 supplies predetermined power to the coils 71 to 73 via the exciting circuit 22. When the fixing apparatus is powered ON, power is supplied to the non-contact temperature detecting elements 81, 82, 91, 92 as well, and the roller temperatures Rt81, Rt82, Rt91, Rt92 are detected (S2).

The IH controller 21 executes heating control of the heat roller 2 in a warming-up mode on the basis of the roller temperatures Rt81, Rt82, Rt91, Rt92 (S3). Then, for example, the roller temperatures Rt81, Rt91 rise as shown in FIG. 3.

Thereafter, the IH controller 21 determines whether or not the detected roller temperature Rt81 has reached a set value (160° C.) which is a fixing temperature (S4). When the roller temperature Rt81 reaches the set value or more (S4—YES), the IH controller 21 determines whether or not a difference between the detected roller temperature Rt91 and the roller temperature Rt81 is equal to or greater than the first specified temperature difference (40° C.) (S5).

When the difference between the roller temperature Rt81 and the roller temperature Rt91 is less than 40° C. (S5—NO), the IH controller 21 determines whether or not the roller temperature Rt91 has reached a set value (160° C.) which is a fixing temperature (S6). When the roller temperature Rt91 becomes equal to or greater than the set value (S6—YES), it is determined whether or not a difference between the roller temperature Rt81 and the roller temperature Rt82 is within a predetermined specified value (S7).

When the difference between the roller temperature Rt81 and the roller temperature Rt82 is within the specified value (S7—YES), it is determined that the heat roller 2 has been heated uniformly in the longitudinal direction up to a temperature indicated by the set value, and warming-up completes. After warming-up has terminated, in the case where a print reservation or command is supplied (S8—YES), temperature control by the IH controller 21 based on a fixing mode is executed (S9). In the case where a print reservation is made (S8—NO), it is determined whether or not power is turned OFF (S10). In the case where power is turned OFF (S10—YES), these temperature controls are terminated.

If power is kept to be ON (S10—NO), the IH controller 21 controls the surface temperature of the heat roller 2 to be maintained on the basis of a ready mode (S11). In the case where this ready mode lasts for a predetermined or longer time, temperature control in an energy saving mode can be executed.

On the other hand, turning to step 5, in the case where the difference between the roller temperature Rt81 and the roller temperature Rt91 is equal to or greater than 40° C. (S5—YES), the counter 28 adds 1 to an initial value (zero) of the first specified value temperature excess count C1 (S12). The IH controller 21 determines whether or not the first specified value temperature excess count C1 is continuously counted, and the count value reaches the specified count value (for example, 5) (S13). If the count value is less than 5 (S13—NO), processing returns to step S2 in which temperature control is executed on the basis of the detected roller temperatures Rt81, Rt82, Rt91, Rt92.

Then, if the continuously counted count value is equal to or greater than 5 (S13—YES), an error signal is outputted, and inductive heating by the induction heating device 7 is stopped (S14).

On the other hand, turning to step S4, in the case where the roller temperature Rt81 is less than the set value (S4—NO), the IH controller 21 determines whether or not the difference between the roller temperature Rt81 and the roller temperature Rt91 is equal to or greater than the second specified temperature difference (10° C.) (S15). In the case where the difference between the roller temperature Rt81 and the roller temperature Rt91 is less than 10° C. (S15—NO), processing returns to step S2 in which temperature control is executed on the basis of the detected roller temperatures Rt81, Rt82, Rt91, Rt92.

On the other hand, in the case where the difference between the roller temperature Rt81 and the roller temperature Rt91 has been equal to or greater than 10° C. (S12—YES), the counter 28 adds 1 to an initial value (zero) of the second specified value temperature excess count C2 (S16). The IH controller 21 determines that the second specified value temperature excess count C2 is continuously counted, and the count value reaches the specified count value (for example, 5) (S17). If the count value is less than 5 (S17—NO), processing returns to step S2 in which temperature control is executed on the basis of the detected roller temperatures Rt81, Rt82, Rt91, Rt92.

If the count value is equal to or greater than 5 (S17—YES), an error signal is outputted, and inductive heating by the induction heating device 7 is stopped (S14).

Figure 5:
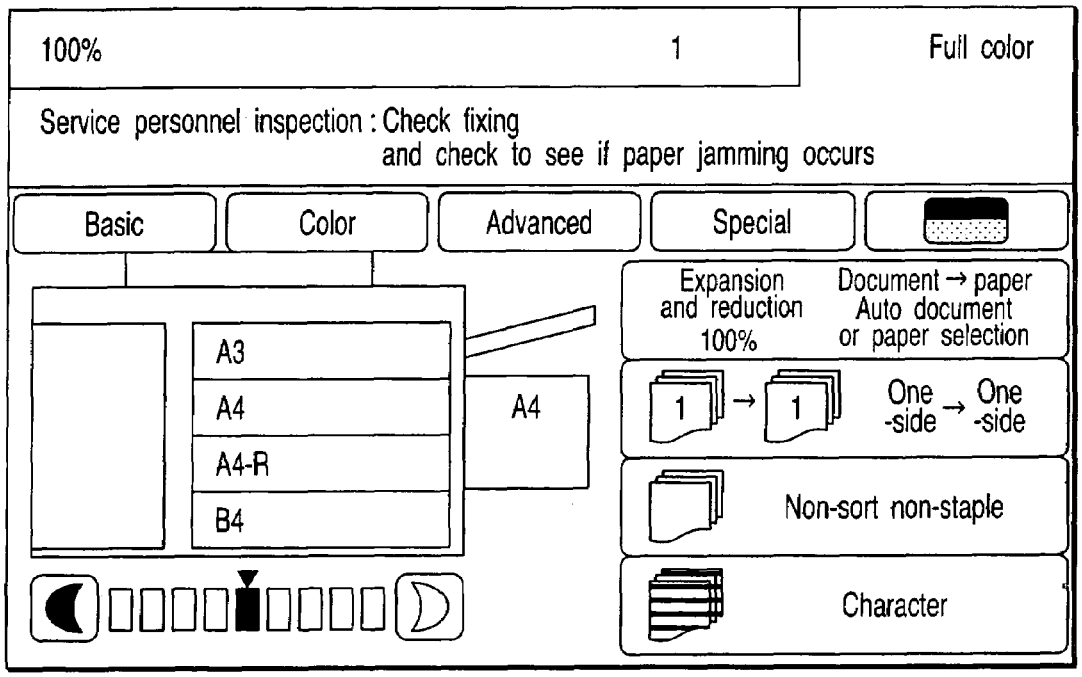
FIG. 5 is a view showing a display section which displays inspection by service personnel.

In addition, turning to step S7, if the difference between the roller temperature Rt81 and the roller temperature Rt82 is greater than the specified value, it is determined that the temperature of the heat roller 2 is not uniform in the longitudinal direction (S7—NO). In the case where the difference between the roller temperature Rt81 and the roller temperature Rt82 is not equal to or smaller than the specified value after the specified time has elapsed (S18—NO), the main CPU 20 determines that the heat roller 2 has failed or that a problem that precise temperature detection cannot be carried out, for example, occurs because a non-contact temperature detecting element is dirty. Then, the display section 25 displays a "service personnel inspection" as shown in FIG. 5 and requires roller replacement or cleaning of the dirty non-contact temperature detecting element (S19). In addition, in step S18, in the case where the specified time has not elapsed (S18—NO), temperature control is executed on the basis of the detected roller temperatures Rt81, Rt82, Rt91, Rt92 such that the temperature in the axial direction of the heat roller 2 becomes uniform.

In this manner, the induction heating device 7 can sense an abnormal rise of the surface temperature of the heat roller 2 in the case where the difference between the roller temperature Rt81 in the vicinity of the exit of the induction heating device 7 and the roller temperature Rt91 near the nip is compared with the first specified value temperature or the second specified value temperature, and the difference between the temperature Rt81 and the temperature Rt91 exceeds the first and second specified value temperature by a predetermined count or more. Therefore, there is no possibility that the heat roller 2 is heated up to a temperature which is much higher than the set value and is overshot, and damage with the heat roller 2 can be reduced. Accordingly, the service life of the heat roller 2 can be extended.

As described above, the temperature difference between the roller temperature Rt81 and the roller temperature Rt91 is compared with the first specified temperature difference or the second specified temperature difference after determining whether or not the roller temperature Rt81 has reached a predetermined set value. Thus, the roller temperature Rt81 in the vicinity of the induction heating device 7 is compared with the predetermined specified value, and concurrently, the compared value can be compared with a specified value of an arbitrary temperature difference. Accordingly, a local temperature change of the heat roller 2 can be sensed more precisely.

In the embodiment, there are two specified values for comparing the temperature difference between the roller temperature Rt81 and the roller temperature Rt91. The present invention is not limited to these values. A configuration is possible in which a plurality of set values to be compared with the roller temperature Rt81 in step S4 shown in FIG. 4 are provided, two or more specified temperature differences may be provided. In this manner, a local temperature change of the heat roller 2 can be sensed more precisely.

Namely, a method of sensing a local abnormal temperature of the heat roller includes a method of sensing whether or not the heat roller is rotated, and, in the case where rotation of the heat roller stops, determining that the heat roller locally rises to an abnormal temperature, and then, stopping an inductive heating operation of the inductive heating apparatus. When the metal conductive layer and the axial core of the heat roller are disengaged from each other, or alternatively, when jamming of the paper P jams occurs between the heat roller 2 and the pressure roller 3, it is impossible to sense that only the metal conductive layer stops even if the heat roller rotates. Thus, it is impossible to detect that the heat roller rises to an abnormal temperature.

In the temperature control method according to the invention, even in the case as described above, it is possible that the heat roller has risen to an abnormal temperature.

The above-described first and second specified temperature differences or the set values of the first and second specified temperature excess counts C1, C2 can be changed on a device by device basis according to the fixing apparatus control method, the performance of the non-contact temperature detecting element, and the like.

While the embodiment has described that, in step S4, the roller temperature Rt81 is compared with the set value (160° C.) which is the fixing temperature, the invention is not limited to this set value. The roller temperature can be set at an arbitrary temperature.

The heating apparatus control method shown in FIG. 3 is provided as a method featured in that the heat roller 2 is rotated at the same time as when warming-up control is made. However, the invention is not limited to the above method. For example, a method featured in that the heat roller 2 is rotated after a predetermined time has elapsed, as shown in, for example, FIG. 6 may be used.

Figure 6:
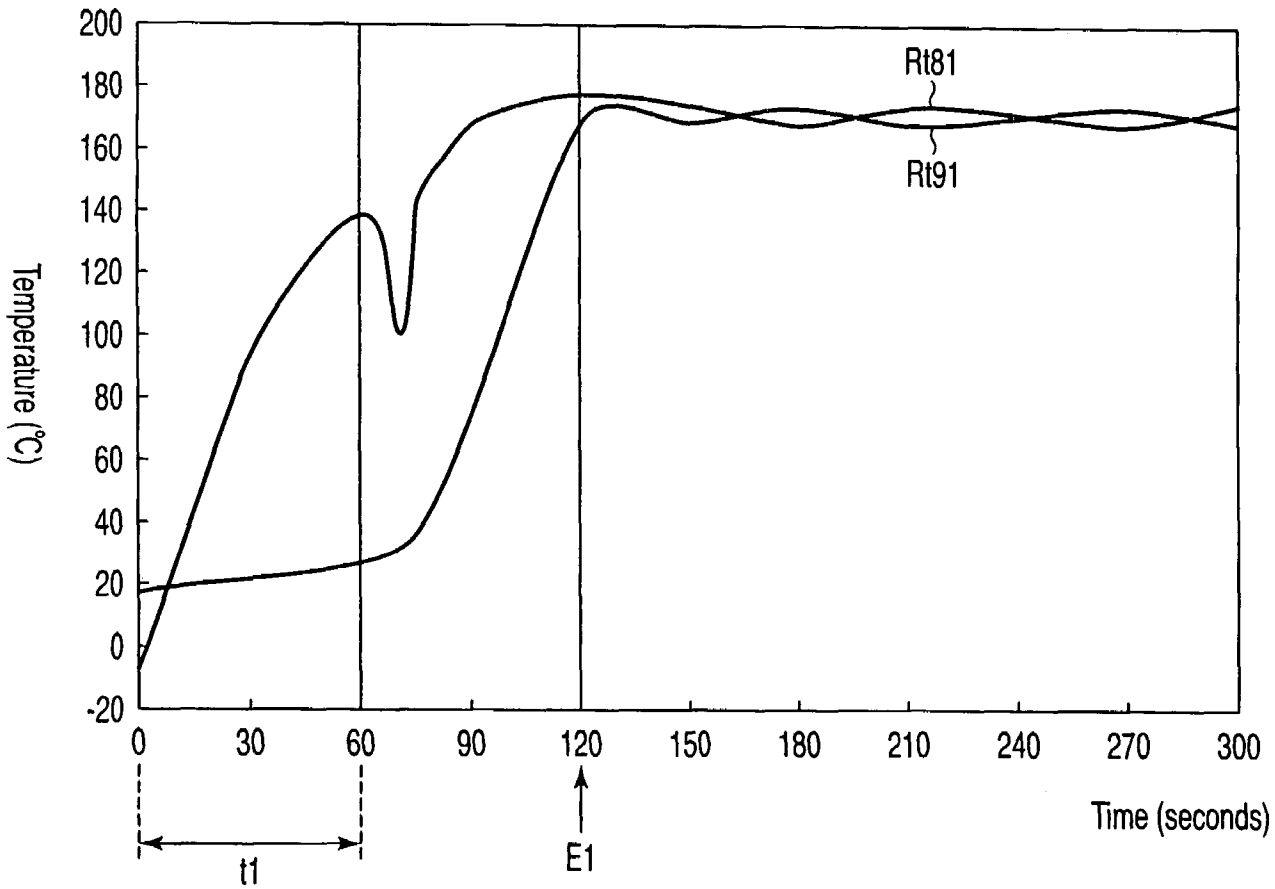
FIG. 6 is a view showing a relationship of a detected temperature detected by the first and second temperature detecting sections and a time in a fixing apparatus for rotating a heat roller after elapse of a predetermined time.

FIG. 6 is a view showing a relationship between a detected time detected by the first and second temperature detecting sections 8, 9 and a time in the fixing apparatus for rotating the heat roller 2 after a predetermined time (E1) has elapsed, as described above.

As shown in FIG. 6, when warming-up is started, the roller temperature Rt81 in the vicinity of the exit of the induction heating device 7 rapidly rises, and the roller temperature Rt91 near the nip gently rises. When the heat roller 2 is rotated after a predetermined time "t1" has elapsed, the roller temperature Rt81 in the vicinity of the exit is lowered, and the roller temperature Rt91 near the nip gradually rises. When the roller temperature Rt81 in the vicinity of the exit reaches a set value (180° C.) (E1), warming-up completes.

By shifting a timing of rotating the heat roller 2 in this way, the temperature of the heat roller 2 is prevented from being lost by the pressure roller 3 due to rotation at the earlier stage of warming up, and the heat roller 2 can be efficiently heated.

In addition, in the case of the fixing apparatus in which the heat roller 2 is rotated after elapse of a predetermined time, as shown in FIG. 6, a change in temperature difference between the temperature Rt81 in the vicinity of the exit and the temperature Rt91 near the nip due to an elapse of time is different from that in the case of the fixing apparatus in which the heat roller 2 is rotated at the same time as when warming-up control shown in FIG. 3 is made.

In such a case, the heating apparatus control method shown in FIG. 4 can be utilized by changing the first and second specified temperature differences or the specified values of the first and second specified temperature excess counts C1, C2 described above.

In addition, the heating apparatus control method according to the present invention may be provided as a method for using the characteristics as shown in FIG. 6, thereby comparing the difference between the roller temperature Rt81 in the vicinity of the exit and the roller temperature Rt91 before and after rotation of the heat roller 2 is started. In this case where the temperature difference between the roller temperature Rt81 and the roller temperature Rt91 after rotation of the heat roller 2 has been started is not smaller as compared with the temperature difference between the roller temperature Rt81 and the roller temperature Rt91 before rotation of the heat roller 2 is started, the heat roller 2 does not rotate, or alternatively, the heat roller 2 rotates, but the metal electrically conducting later 2*c* does not move. Thus, there is a possibility that the heat roller 2 is heated to an abnormal temperature, and therefore, a heating operation of the induction heating device 7 is stopped.

Further, the heating apparatus control method according to the present invention may be provided as a method for using the characteristics as shown in FIG. 6, thereby determining whether or not the difference between the roller temperature Rt81 in the vicinity of the exit and the roller temperature Rt91 near the nip converges after rotation of the heat roller 2 has been started.

The present invention is not limited to the above-described embodiment, and can be embodied by modifying constituent elements without departing from the spirit of the invention at the stage of carrying out the invention. In addition, a variety of inventions can be formed by using a proper combination of a plurality of constituent elements disclosed in the embodiment. For example, some of all the constituent elements disclosed in the embodiment may be erased. Further, the constituent elements over the different embodiments may be properly combined with each other.

Figure 7:
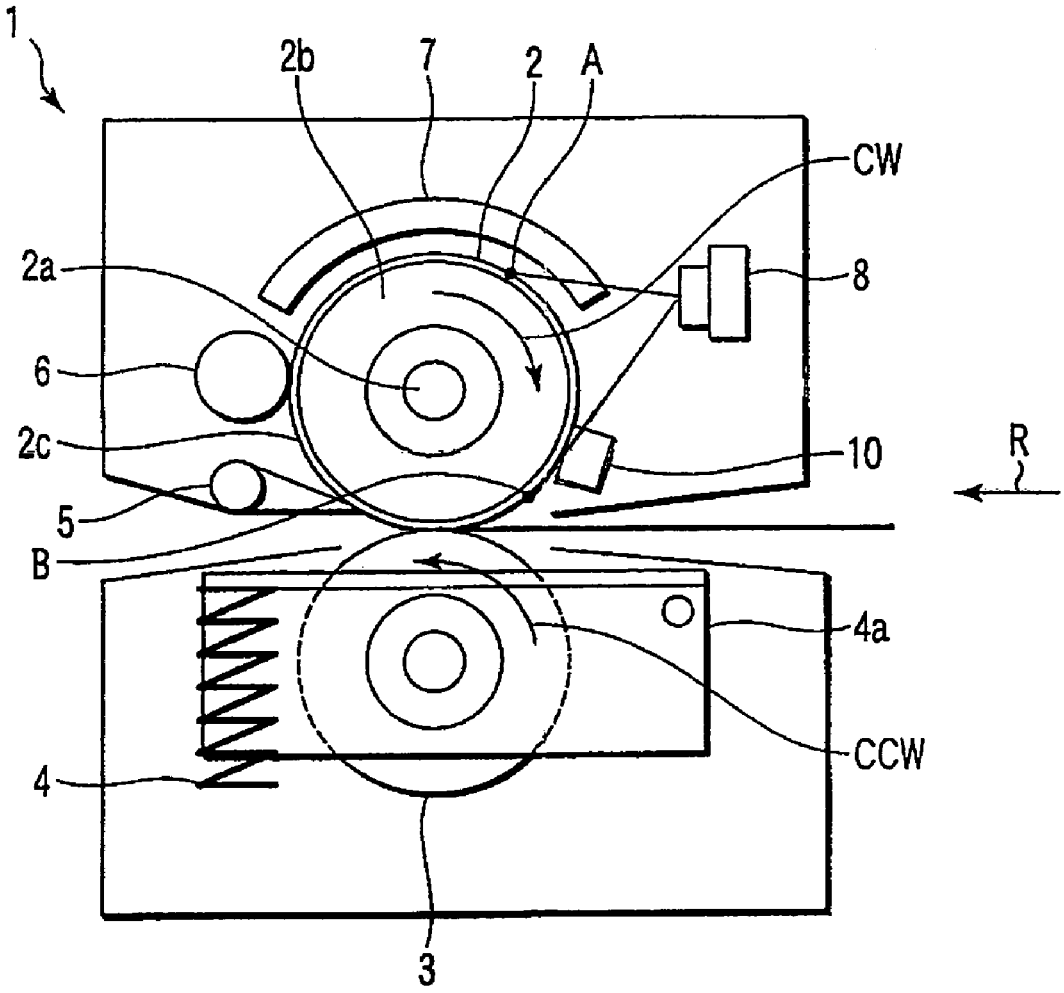
FIG. 7 is a schematic view illustrating an example of a fixing apparatus according to another embodiment of the invention.

For example, while the non-contact temperature detecting elements 81, 82, 91, 92 have been described as constituent elements capable of detecting a temperature of one site by one element, the present invention is not limited to these constituent elements. For example, as shown in FIG. 7, a non-contact temperature detecting element for detecting temperatures of two or more sites by one element may be used. In this case, it is preferable that the roller temperatures Rt81, Rt91 which can be detected by the non-contact temperature detecting element 81 and the non-contact temperature detecting element 91 are detected by one non-contact temperature detecting element, and that the roller temperatures Rt82, Rt92 which can be detected by the non-contact temperature detecting element 82 and the non-contact temperature detecting element 92 are detected by one non-contact temperature detecting element.

Figure 8:
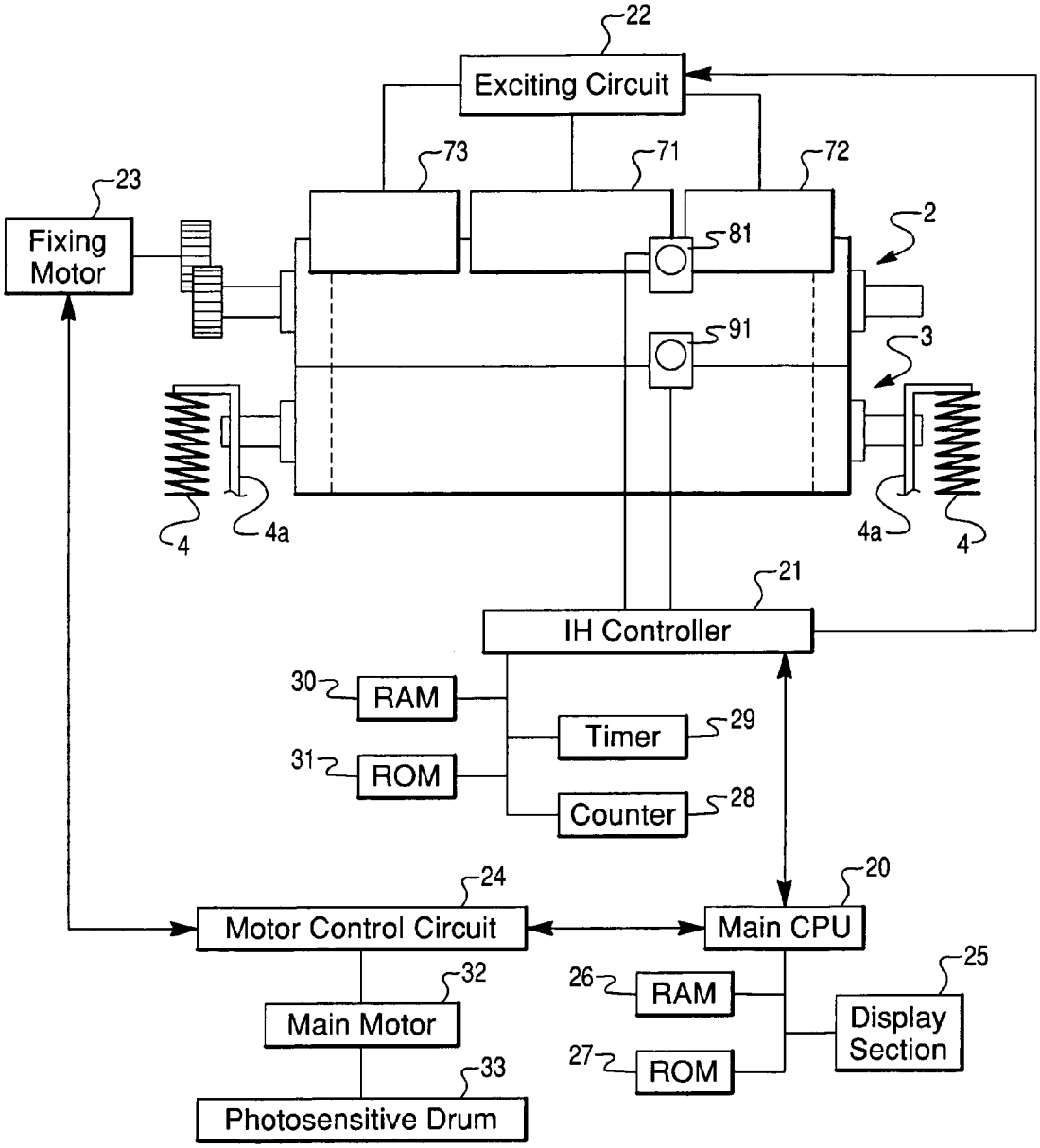
FIG. 8 is a block diagram illustrating a control system of a fixing apparatus according to still another embodiment of the invention.

Furthermore, the non-contact temperature detecting sections 8, 9 each may be configured to be allocated in a region opposed to at least the center coil 71 and at a position opposed to a region opposed to the end coil 72. As shown in FIG. 8, these detecting sections may be configured to be allocated at a joint of the coils and in a region opposed to each of the coils 71 to 73.

Moreover, the non-contact temperature detecting section 9 may detect a surface temperature of at least one of the heat roller 2 and the pressure roller 3. For example, the detecting section may be allocated at a position for sensing the surface temperature of the heat roller 3. In this case, it is preferable that the non-contact temperature detecting section 9 detect a temperature in the vicinity of the nip of the pressure roller 3.

In addition, while the embodiment has described that the fixing temperature of the heat roller 2 is set to 160° C., the present invention is not limited thereto. The setting can be changed depending on equipment structure, a melting point of an available developer and the like. Further, this setting depends on size, type or thickness of a recording medium. For example, when the recording medium is thick, the temperature is set to be higher than usual.

Further, while the embodiment has described a method of generating a magnetic flux which is an arbitrary heating force from the coils 71 to 73 by setting an amount of power, the present invention is not limited to this method. A method of changing a heating force by selecting a frequency of a flow current for each of the coils 71 to 73 may be used.

While the embodiment uses a configuration of applying a pressure from the pressure roller 3 to the heat roller 2, the present invention is not limited to this configuration. A configuration of applying a pressure from the heat roller 2 to the pressure roller 3 may be used.

A configuration of using a contact type sensor together to detect the temperature of the heat roller 2 may be also employed.

In the non-contact temperature detecting element 81, at least the thermo pile and thermister may be allocated in the fixing apparatus, and a control circuit or the like may be allocated outside of the fixing apparatus.

As in the embodiment, in the case of utilizing a temperature detecting mechanism which includes a plurality of temperature detecting sections and which can detect a plurality of sites of the heat roller 2, it is preferable that the temperature detecting sections are allocated at the upstream and downstream sides with respect to the nip, thereby making control so that a difference (ripple) between a temperature of an upstream portion and a temperature of a downstream portion of the nip is within the range of the preset specified values.

Furthermore, with respect to temperature control in the above-described warming-up mode, in the case where a time at which the roller temperature Rt81 detected by the non-contact temperature detecting element 81 reaches a set value which is a fixing temperature is slower than a specified time defined as a warming-up time, power supplied to the coils 71 to 73 of the induction heating device 7 can be temporarily increased.

Moreover, the fixing apparatus according to the invention may be provided as a fixing apparatus capable of making a color copy or capable of making a monochrome copy.

What is claimed is:

1. A fixing apparatus comprising:

a heat roller which supplies heat to a sheet;

a pressure roller which comes into contact with the heat roller;

a heating apparatus having a plurality of heating members which heat the heat roller;

a first non-contact temperature detecting section which is provided in non-contact with a surface of the heat roller, and which detects a surface temperature of the heat roller in the vicinity of the heating apparatus;

a second non-contact temperature detecting section which is provided in non-contact with the surfaces of the heat roller and the pressure roller, and which detects a surface temperature of at least one of the heat roller and the pressure roller;

a counter section for counting; and a control section which is connected to the counter section, compares a difference between a first temperature detected by the first non-contact temperature detecting section and a second temperature detected by the second non-contact temperature detecting section with a predetermined specified temperature difference, and continuously counts, by the counter section, a case in which the difference between the first temperature and the second temperature is greater than the specified temperature difference by a predetermined number of times, thereby detecting a predetermined period, and when the difference between the first temperature and the second temperature is greater than the specified temperature difference for the predetermined period or longer, stops heating of the heat roller by the heating apparatus.

2. A fixing apparatus according to claim 1, wherein the second non-contact temperature detecting section detects a surface temperature in the vicinity of a contact portion between the heat roller and the pressure roller.

3. A fixing apparatus according to claim 1, wherein the first non-contact temperature detecting section and the second non-contact temperature detecting section are integrally formed with one non-contact temperature detecting element.

4. A fixing apparatus according to claim 1, wherein the control section has a first specified temperature difference as the specified temperature difference and a second specified temperature difference which is different from the first specified temperature difference, when the first temperature is a predetermined set value or more, the difference between the first temperature and the second temperature is compared with the first specified temperature difference, and when the difference between the first temperature and the second temperature is greater than the first specified temperature difference for a predetermined period or more, heating of the heat roller is stopped by the heating apparatus, and when the first temperature is less than a predetermined set value, the difference between the first temperature and the second temperature is compared with the second specified temperature difference, and when the difference between the first temperature and the second temperature is greater than the second specified temperature difference, heating of the heat roller is stopped by the heating apparatus.

5. A fixing apparatus according to claim 1, wherein the heating apparatus includes two or more inductive heating coils allocated outside of the heat roller, and heats the heat roller by inductive heating.

6. A fixing apparatus according to claim 5, wherein the first non-contact temperature detecting section and the second non-contact temperature detecting section include a plurality of non-contact temperature detecting elements, and detect at least one of a surface temperature of the heat roller opposed to a center portion of the inductive heating coil and a surface temperature of the heat roller opposed to a joint portion between the inductive heating coils.

7. A heating apparatus control method comprising:

heating an outer periphery face of a heat roller by a heating apparatus which includes a plurality of inductive heating coils allocated outside of the heat roller;

detecting a first temperature from a first non-contact temperature detecting section which detects a surface temperature of the heat roller in the vicinity of the inductive heating coil;

detecting a second temperature from a second non-contact temperature detecting section which detects a temperature of a surface region of the heat roller which is distant from a region detected by the first non-contact temperature detecting section;

determining whether or not a temperature difference between the first temperature and the second temperature has reached a first specified temperature difference;

when the temperature difference between the first temperature and the second temperature has reached the first specified temperature difference, continuously counting the case in which the difference between the first temperature and the second temperature has reached the first specified temperature by a predetermined number of times, thereby detecting a predetermined period; and stopping heating of the heat roller by the heating apparatus in the case where a period in which the first specified temperature difference has been reached reaches the predetermined period or more.

8. A heating apparatus control method according to claim 7, further comprising:

determining whether or not the first temperature has reached a specified value; and when the first temperature has reached the specified value, determining whether or not the temperature difference between the first temperature and the second temperature has reached the first specified temperature difference.

9. A heating apparatus control method according to claim 8, further comprising:

when the first temperature does not reach the specified value, determining whether or not the temperature difference between the first temperature and the second temperature has reached a second specified temperature difference; and when the temperature difference between the first temperature and the second temperature has reached the second specified temperature difference, stopping heating of the heat roller by the heating apparatus in the case where a period in which the first specified temperature difference has been reached reaches a predetermined period or more.

10. A heating apparatus control method according to claim 9, further comprising:

when the temperature difference between the first temperature and the second temperature has reached the second specified temperature difference, counting the number of times when temperature differences have been detected, and when the counted number of times becomes continuously a predetermined set value or more, stopping heating of the heat roller by the heating apparatus.

11. A heating apparatus control method according to claim 7, further comprising:

when the temperature difference between the first temperature and the second temperature has reached the first specified temperature difference, counting the number of times when temperature differences have been detected, and when the counted number of times becomes continuously a predetermined set value or more, stopping heating of the heat roller by the heating apparatus.

12. A fixing apparatus comprising:

a heat roller which supplies heat to a sheet;

a pressure roller which comes into contact with the heat roller;

a heating apparatus having a plurality of heating members which heat the heat roller;

a first non-contact temperature detecting section which is provided in non-contact with a surface of the heat roller, and which detects a surface temperature of the heat roller in the vicinity of the heating apparatus;

a second non-contact temperature detecting section which is provided in non-contact with the surfaces of the heat roller and the pressure roller, and which detects a surface temperature of at least one of the heat roller and the pressure roller; and a control section which compares a difference between a first temperature detected by the first non-contact temperature detecting section and a second temperature detected by the second non-contact temperature detecting section with a predetermined specified temperature difference, and when the difference between the first temperature and the second temperature is greater than the specified temperature difference for a predetermined period or longer, stops heating of the heat roller by the heating apparatus;

the control section having a first specified temperature difference as the specified temperature difference and a second specified temperature difference which is different from the first specified temperature difference, when the first temperature is a predetermined set value or more, the difference between the first temperature and the second temperature is compared with the first specified temperature difference, and when the difference between the first temperature and the second temperature is greater than the first specified temperature difference for a predetermined period or more, heating of the heat roller is stopped by the heating apparatus, and when the first temperature is less than a predetermined set value, the difference between the first temperature and the second temperature is compared with the second specified temperature difference, and when the difference between the first temperature and the second temperature is greater than the second specified temperature difference, heating of the heat roller is stopped by the heating apparatus.

* * * * *